United States Patent [19]

Collbrunn et al.

[11] 4,102,281

[45] Jul. 25, 1978

[54] WORKPIECE GUIDE DEVICE FOR SEWING MACHINES

[75] Inventors: Harald Collbrunn, Spenge; Hermann Breitinger, Bielefeld; Herbert Diekmann, Vlotho, all of Fed. Rep. of Germany

[73] Assignee: Dürkoppwerke GmbH, Bielefeld, Fed. Rep. of Germany

[21] Appl. No.: 746,880

[22] Filed: Dec. 2, 1976

[30] Foreign Application Priority Data

Dec. 2, 1975 [DE] Fed. Rep. of Germany ..... 2554022

[51] Int. Cl.[2] ..... D05B 21/00

[52] U.S. Cl. ..... 112/121.26; 112/153

[58] Field of Search ..... 112/153, 136, 140, 203, 112/204, 205, 121.15, 121.26, 148, 220

[56] References Cited

U.S. PATENT DOCUMENTS

| | | | |
|---|---|---|---|
| 3,162,154 | 12/1964 | Medoff | 112/153 X |
| 3,782,310 | 1/1974 | Stockel | 112/153 |
| 3,794,230 | 2/1974 | Bryan et al. | 112/153 X |
| 3,921,550 | 11/1975 | Marforio | 112/153 X |
| 3,973,507 | 8/1976 | Sambus | 112/136 |
| 4,013,025 | 3/1977 | Marforio | 112/153 X |
| 4,013,026 | 3/1977 | Hall | 112/205 X |

*Primary Examiner*—Werner H. Schroeder
*Assistant Examiner*—Moshe I. Cohen
*Attorney, Agent, or Firm*—Karl F. Ross

[57] ABSTRACT

A workpiece guide device for sewing machines, especially for the edge-true seaming of at least two workpiece (fabric) pieces, e.g. trouser parts, on a sewing machine, comprises a vertically disposed linear-guide element on the sewing table for alignment of the edges of the pieces to be guided horizontally, and a three-plate stack extending generally transversely to the plane of the linear edge guide and mounted upon a slide for movement toward and away from the stitching location. Preferably clamping means is provided to engage the fabric pieces between the plates.

4 Claims, 6 Drawing Figures

WORKPIECE GUIDE DEVICE FOR SEWING MACHINES

FIELD OF THE INVENTION

The present invention relates to a workpiece guide device for edge-true seaming or sewing, especially of trouser pieces, on a sewing machine.

BACKGROUND OF THE INVENTION

For the sewing of trouser pieces, i.e. two pieces of fabric adapted to be stitched together along a pants leg or the like in the formation of a pair of trousers, an edge-true stitching of the pieces is required. The term "edge-true" is used herein to refer to the stitching of a substantially linear seam along trouser legs or the like with the two pieces preferably aligned along the edge at which the seam is to be formed at a given distance from this edge. This distance must be held contant and the two fabric pieces must lie in registry along the edge to be stitched and a substantially rectilinear seam must be formed for effective edge-true stitching.

For the feeding of fabric pieces to be stitched together along a seam at a sewing location in a sewing machine, it is known to provide an edge guide device laterally of the sewing station which is provided with a substantially vertically oriented linear guide surface along which the edges of the pieces are held as the pieces are guided past the sewing location. The fabric is guided by hand or by compressed air in an edge-true relationship along this guide surface.

The guide element can be provided with guide plates which extend transversely to the guide surface and at least partially cover the fabric pieces at their edge regions, i.e. overlie the latter, and serve to separate the pieces from one another until they reach the stitching location. This ensures a better guidance of each individual fabric piece and prevents bunching thereof at the guide surface.

It has been proposed fairly recently to facilitate the feeding of the fabric pieces along the guide surface, by providing a pair of guide rollers which, although not driven, engage the fabric and impart a force component thereto in the direction of the guide surface and hence enable the self-feeding effect of the sewing machine to advance the fabric past the stitching location in edge-true relationship. Such a device is described for example in German Utility Model (Gebrauchsmuster) No. 7.330.505.

With such a device, the sewing machine operator need merely bring the fabric pieces into contact with the guide surface and into the region of the stitching location, whereupon the self-feeding effect ensures edge-true seaming of the two pieces. In this manner the leg portions of a pair of trousers, having straight leg seams, can be sewn with self-feeding and self-guidance of the fabric parts, requiring a minimum of handling by the operator.

However, this arrangement is ineffective for the sewing of waistband and pocket or other intricate regions of the trousers. The pocket parts of such devices cannot be effectively brought under the guide plates and, since they are generally previously attached to the fabric pieces, the plates interfere with the manipulations by the operator to sew these portions of the trousers. However, after the pocket parts, waistband portions and like complicated parts of a pair of trousers are stitched, it is desirable to again use the plates for guiding the fabric parts during further leg-seam stitching.

In German Utility Model (Gebrauchsmuster) No. 7.319.362, there is described a workpiece guide device in which a preferably pneumatically driven plate is swingable about a vertical axis and can be rotated into the guiding position to serve for the guiding and separation of the fabric pieces during the legs seam stitching of the trousers. Moreover, this plate can be readily swung into an inoperative or ineffective position when the pocket portions, waistband and like parts of the trousers are to be stitched. Consequently, the pocket parts can be sewn under manual control with simple guidance of the fabric pieces by hand without interference by the guide and separating plates while the leg parts can be stitched with the use of the guide plates under self-guidance and self-feeding of the fabric segments.

OBJECT OF THE INVENTION

It is the object of the present invention to provide a device, preferably in combination with a sewing machine, which facilitates the leg-seam stitching of trousers without the disadvantages of the aforedescribed systems, which minimize the hand work required for the sewing of trousers, and which reduces the handling time for the sewing of such articles.

SUMMARY OF THE INVENTION

The foregoing object and others which will become apparent hereinafter are attained, in accordance with the present invention, in a workpiece feed device for the edge-true stitching of fabric parts together on a sewing machine, preferably for the seaming of trouser parts, which comprises a substantially vertically disposed stationary or fixed edge guide member having a linear guide path for the fabric pieces past the stitching location, and laterally thereof a stack of plates for the guiding and separation of the fabric pieces. In accordance with the invention, these plates are mounted on a slide which is shiftable from a predetermined distance away from the stitching location substantially to the latter along a linear guide member which is parallel to the aforementioned linear guide plane.

According to a feature of the invention, the slide is provided with a fabric clamp which secures the portions of the fabric pieces received between the plates in their original relationship during or prior to movement of the slide. This clamp can be a compressed-air cylinder which is disposed vertically above the plates and has a piston reaching through an opening in the upper plate and adapted to press the intermediate plate downwardly toward the lower plate and seize the fabric pieces disposed above the intermediate plate directly while the fabric piece disposed between the intermediate plate and the lower plate is engaged between them under the pressure of this compressed air cylinder.

According to still another feature of the invention, the slide is provided with additional guide means for the fabric pieces which cooperate with the stationary edge guide on the sewing machine table and with the plates.

It has been found to be advantageous, moreover, to provide the linear guide member for the slide as a guide bar which lies in a plane parallel to the stationary linear guide but which is movable parallel to the plane in which the fabric pieces lie. To this end, the guide bar can be swingable about a vertical axis and driven by a motor or by hand.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
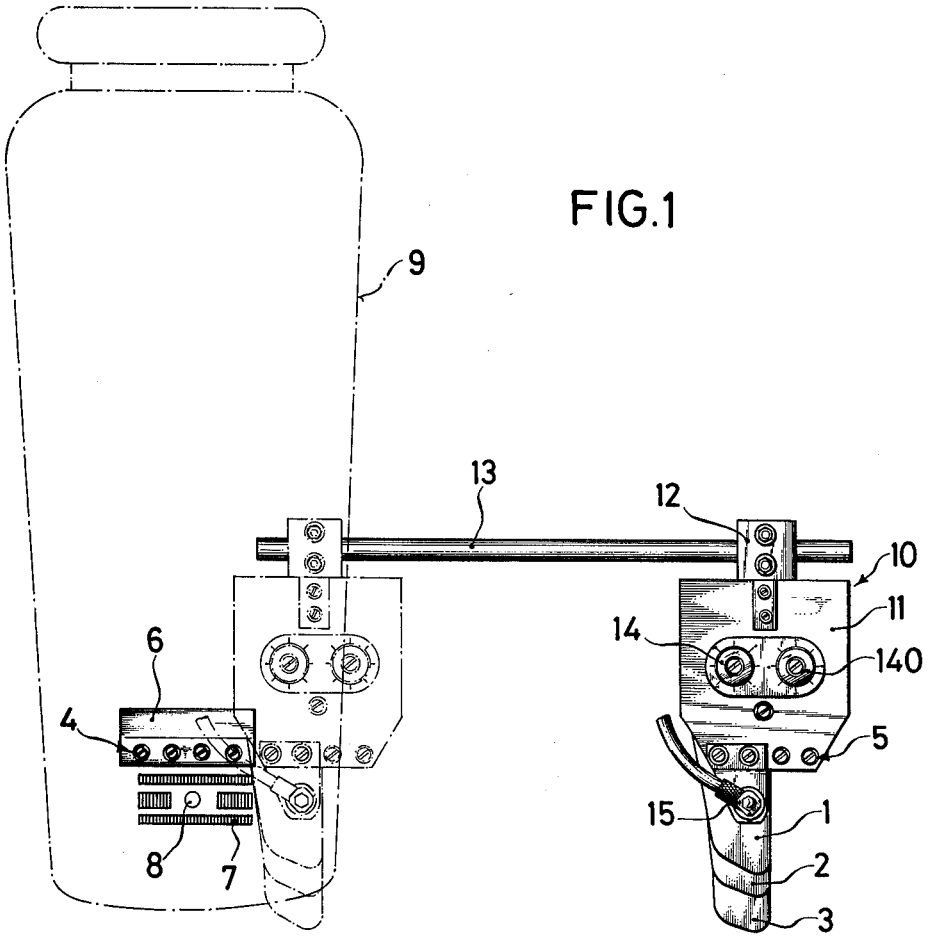
FIG. 1 is a plan view of a fabric guide device according to the invention and the stitching station of a sewing machine.

The fabric guide device, according to the invention, comprises a stack of plates 1, 2, 3, consisting of an upper plate 1, an intermediate plate 2 and a lower plate 3, the plates extending generally perpendicular to the vertical guide plane defined by an array of vertical pins 4 which form part of a linear edge guide. The linear edge guide is stationarily mounted on the stitching table of a sewing machine by an angle bracket 6. The sewing machine is represented in dot-dash lines at 9 in FIG. 1 and the brackets 6 may be attached by screws to the stitching table. The guide plane is also defined by an array of pins 5 movable edge guide aligned with the pins 4 but disposed laterally thereof on a slide 10 which will be described in greater detail hereinafter.

The two rows 4 and 5 of guide pins thus lie in a common vertical plane as can be seen in FIG. 1, i.e. the rows are algined.

Side 10 is shiftable between its solid line right hand extreme position (FIG. 1) and its dot-dash left hand extreme position proximal to the stitching location which is here represented by a stitching hole 8 into which the sewing machine needle projects during seaming of the pair of trousers using the deivce of the present invention.

The extreme right hand position of the slide 10 may be established by an adjustable stop 13*a* (FIG. 4) in accordance with the optional supporting position for the trouser pieces to be sewn. The extreme left hand position may be established by another adjustable stop 13*b*, the two stops being locked onto a guide bar 13 parallel to the linear guide plane by respective screws.

The two rows 4 and 5 of guide pins constitute an eight-pin-linear edge guide with equispaced pins when the slide 10 is proximal to the stitching location (dot-dash lines in FIG. 1). The stitching location of the sewing machine 9 is provided with the usual fabric-feed teeth 7 flanking the stitching hole 8 and, of course, the overhanging arm of the sewing machine, which can be of any commercial type, can be provided with a foot for clamping the fabric against the feed teeth 7.

Figure 2:
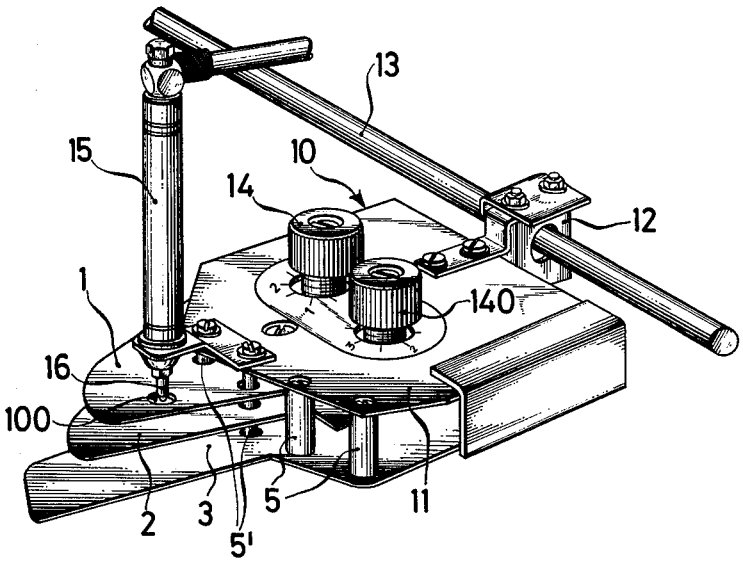
FIG. 2 is a perspective view of the slide according to the invention.

Slide 10 is provided, as is best seen in FIG. 2, with a cover plate 11 below which the plates 1, 2 and 3, in vertically spaced relationship, are disposed, the plates 1,2 and 3 being of overlapping configuration to facilitate insertion of the two layers of fabric to be stitched together, the lower layer above the plate 3 and below the plate 2 and the upper layer, above the plate 2 and below the plate 1. Thus the end of plate 2 is set back from the end of plate 3 while the end of plate 1 is set back from the end of plate 2.

The cover plate 11 and the plates 1 - 3 are preferably punched, stamped or cut from sheet metal. At least the intermediate plate 2 is deflectable in a vertical direction.

The lower plate 3 and the cover plate 11 are connected together by the four guide pins 5 previously mentioned so that a type of double frame is provided which encloses the functioning parts and serves to guide the movable plates 1 and 2 in the vertical direction.

The lower plate can rest directly on the sewing table or upon an underlay for the fabric parts to be stitched.

The cover plate 11 is further provided with a slide bushing 12 of any conventional slide bearing material, e.g. bronze, whereby the slide-10 is displaceable along the rectilinear guide member or bar 13 previously mentioned.

The guide bar 13 or tract is, in the embodiment illustrated, substantially at a right angle to the sewing machine and its left hand end can be mounted by means not shown in FIGS. 1 and 2 upon the sewing table. Above the cover plate 11, there are provided a pair of milled adjusting knobs 14 and 140 for setting the relative spacing of the upper plate 1 and the intermediate plate 2 and thus the width of the gaps between plates 1 and 2 and between plates 2 and 3 for different fabric thicknesses.

The adjusting mechanism is better illustrated in FIG. 3 and will be described in more detail hereinafter. For the present it can be noted that the adjusting knobs 14 and 140 can be provided with respective threaded portions which are screwed into nuts mounted on the underside of the cover plate 11 and can bear upon the plates 1 and 2 against the force of respective springs so that the respective springs are more or less compressed depending upon the extent to which the knobs 14 and 140 are rotated. The knob 14 can bear upon the upper plate 1 directly while the other knob passes through an opening thereof to bear upon the intermediate plate 2.

The slide 10 is provided with a fabric clamp 15 which can be advanced and retracted and, in the embodiment illustrated, comprises a compressed air cylinder whose piston rod 16 passes through an opening 100 in the upper plate 1 and can engage a fabric overlying the intermediate plate 2 and/or can press the intermediate plate 2 against the fabric piece overlying the bottom plate 3. As a result, the fabric pieces disposed between the plates 1, 2 and 3 can be clamped together or released, upon retraction of the piston rod 16.

The slide 10 is, in operation, brought into its extreme right hand position against the stop 13*a* and the distance between the right hand extreme position of the slide and the sewing location can correspond to the length of the linear seam to be produced in the trousers and in any event is at least sufficient to permit the waistband and pocket regions of the trouser pieces to be sewn. Of course, the slide 10 can be positioned at a location spaced from the stitching location sufficient to clear the pocket and wastband regions when these are sewn and then can remain in place while the fabric pieces are drawn between the plates 1,2,3 and along the guide rows 4 and 5. The operator simply inserts the fabric pieces between the plates 1 – 3 and against the edge guide rows 4 and 5, begins sewing machine operations and permits the self-feeding of the sewing machine to draw the fabric pieces along the edges guides and separated by the plates 1 – 3 to the sewing location where the pieces are united in the stitched seam. Of course, when the slide 10 is to be moved along with the fabric pieces as they are drawn to the sewing machine, the cylinder 15 is pressurized and the fabric clamp is engaged. In this case, the fabric clamp 15 acts as a holder for the edge-true relationship of the fabric pieces during the sewing operation. As the ends of the fabric pieces reach the sewing location, the clamp 15 can be released and the fabric pieces drawn from between the plates 1 – 3.

Of course, the clamping can be maintained only during the sewing of the pocket and waistband regions to assist the operator in holding the fabric pieces together, whereupon the clamp is released so that the fabric pieces are guided through the gaps between the plates 1 – 3. In the latter case, after sewing the side seams of the wastband and pocket regions, the slide 10 assumes the dot-dash extreme left position illustrated in FIG. 1 and the leg-seam stitching is effected exclusively by drawing the fabric pieces between the plates 1 – 3. This reduces the manipulating time for the fabric pieces and allows a continuous flow of the stitching operation as to release of the clamp 15 by the self-guiding effect mentioned above the practically without any action on the operator's part.

It is possible in accordance with the invention, to use the inclined rollers of German Utility Model (Gebrauchsmuster) No. 7.330.505 to maintain the fabric pieces against the edge guides 4, 5.

To assist in the movement of the fabric pieces past the stitching location for the waistband and pocket sewing of the trousers, the guide bar 13 can be swingable in a plane parallel to the fabric preferably about a vertical axis at the left-hand end of the guide bar 13. The movement curve of the slide 10 can correspond to the edge curve of the fabric segments so that even during sewing of the waistband and pocket regions, a given self-guiding effect is obtained. The movement of the slide to the stitching location can also, if desired, be effected by a separate drive which is synchronized with the stitch feed and the clamping device 15 thus serves to lock the slide 10 to the fabric if desired. Of course, when the slide 10 is positively driven in this manner, the clamp 15 can be entirely omitted.

Regardless of the mode of operation which is chosen, it is preferred to provide the fabric clamp since it facilitates the handling of the fabric pieces and prevents dislocation of one piece relative to the other.

In general the guide device of the present invention facilitates complex stitching processes in which parts have had to be stitched heretofore with complicated manipulations. It is especially effective in the sewing of trousers in that it permits a substantially complete self-feeding of the fabric and self-guiding thereof over the major part of the sewing operation at relatively low cost.

Figure 3:
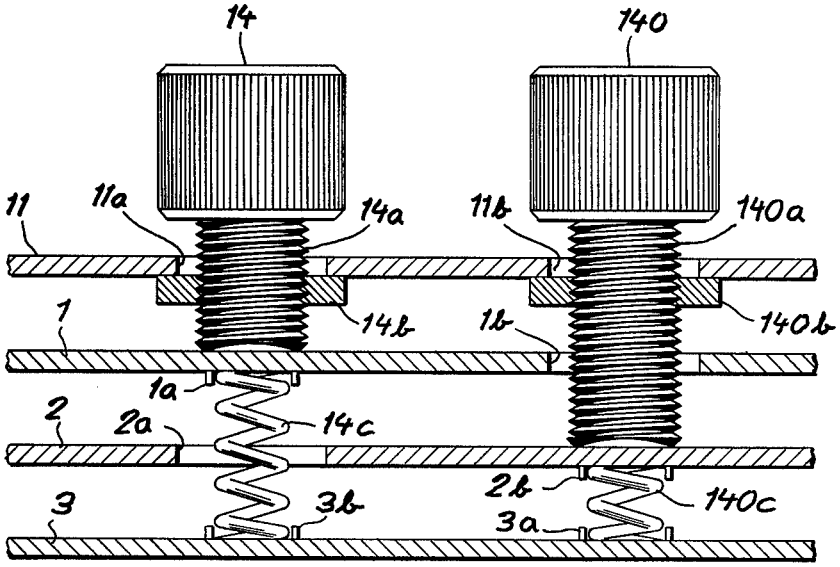
FIG. 3 is a cross-sectional view through the adjusting mechanism of this slide, drawn to an enlarged scale.

In FIG. 3 there is shown a system for adjusting the spacing between the plates 1 and 2 and between the plates 2 and 3, this mechanism comprising a threaded bolt portion 14*a* on the knob 14, the bolt 14*a* being threadedly received with a nut 14*b* fastened on the underside of the upper plate 11 which has a hole 11*a* through which the bolt portion 14*a* passes. The bolt 14*a* bears directly against the upper plate 1 which is urged upwardly by a spring 14*c* guided between projections 1*a* on the underside of the plate 1. The spring 14*c* passes through an opening 2*a* in the plate 2 and rests upon the lower plate 3, being held in position by upwardly projecting protuberance 3*b*.

The bolt 140*a* on the knob 140 passes through an opening 11*b* in plate 11 and threadedly engages a nut 140*b* fastened on the underside of this plate. The bolt 140*a* also passes through an opening 1*b* in the plate 1 to bear directly upon the lower plate 2 which is urged upwardly by a spring 140*c* positioned between protuberances 2*b* and 3*a* on the plates 2 and 3, respectively. To reduce the spacing between the intermediate plate 2 and the bottom plate 3, knob 140 is rotated to press the plate 2 downwardly against the force of spring 140*c*. The spacing of plate 1 relative to plate 2 is similarly adjusted.

Figure 4:
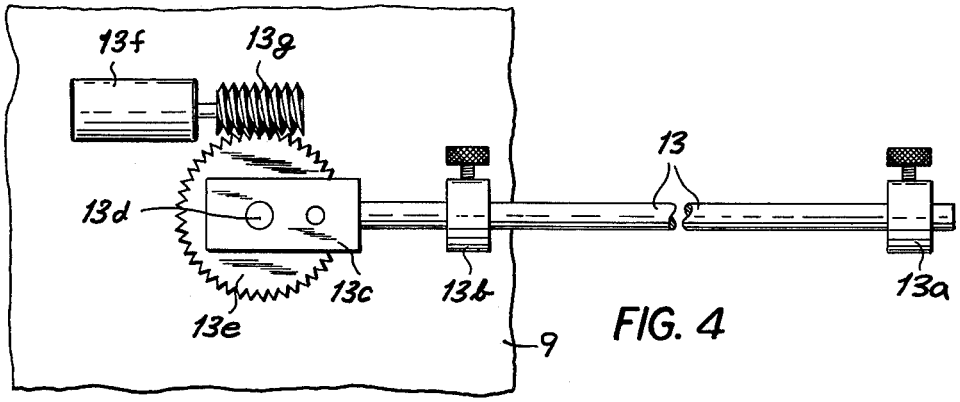
FIG. 4 is a diagrammatic plan view showing the means for swingably displacing the guide bar upon which the slide is mounted.
Figure 5:
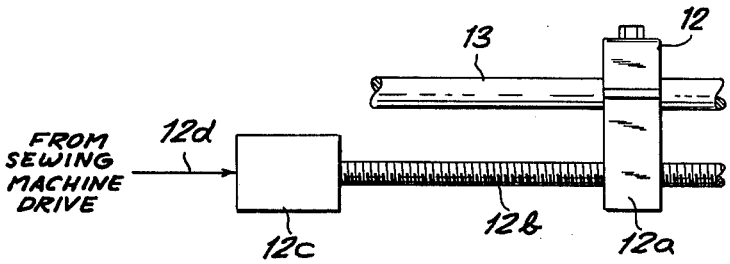
FIG. 5 is a diagrammatic elevational view of the means which can optionally be provided to displace the slide in synchronism with the sewing operation when self-feeding of the fabric is not desired.

In FIG. 4 the guide bar 13 is shown to be mounted on a support 13*c* which is swingable on a shaft 13*d* on the sewing table of the sewing machine. The shaft 13*d*, forming a vertical pivot axis for the bar 13, carriers a worm wheel 13*e* which can be driven by a worm 13*g* from a motor 13*f* to pivot the guide bar 13 in the manner previously described.

Figure 6:
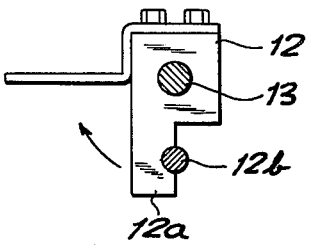
FIG. 6 is an end view of a portion of the latter device.

When positive drive of the slide 10 is required, its slide bushing 12 can be provided with a half nut 12*a* (FIG. 6) engaging a leadscrew 12*b* which is driven by a motor 12*c* synchronized as represented at 12*d* with the sewing machine drive and hence the fabric advance movement of this sewing machine. To shift the slide back into its right-hand position (FIG. 1) the slide may be pivoted in its clock-wise sense (FIG. 6) to disengage the half nut 12*a* from the lead screw 12*b* and permit the slide 10 to be returned to its extreme right-hand position against the stop 13*a* (FIG. 4).

We claim:

1. The combination with a sewing machine having a stitching location on a sewing table, of a fabric-guide device capable of the controlled feeding of a pair of fabric pieces to said stitching location and thereafter forming a guide for the fabric pieces as they are advanced past said location by the fabric-feed members of the sewing machine, said device comprising:

a substantially vertically disposed first linear edge guide fixed on said table adjacent said location;

a guide rail mounted on said machine and extending generally parallel to said first linear edge guide;

a slide shiftable along said rail toward and away from said location, said slide comprising:

a plurality of vertically spaced plates adapted to receive said fabric pieces between them and separating said pieces;

a second linear edge guide movable with said slide and coplanar with said first linear edge guide while forming a guide surface for the individual pieces separated by said plates, and a pneumatic fabric clamp on said slide for securing said pieces against at least one of said plates; and adjustable abutment means along said track for limiting the displacement of said slide therealong and defining extreme positions of said slide proximal to said location and remote therefrom.

2. The combination defined in claim 1 wherein said plates include a bottom plate, an intermediate plate and an upper plate, said intermediate plate having an end set back from an end of said bottom plate, said upper plate having an end set back from said end of said intermediate plate, said pneumatic fabric clamp including a compressed air cylinder mounted above said upper plate and disposed vertically, said upper plate being formed with an opening, said cylinder having a piston rod passing through said opening to press fabric against said intermediate plate;

each of said edge guides including a respective row of vertically extending, spaced apart pins, said slide further comprising means for adjusting the mutual spacing of said plates from one another.

3. The combination defined in claim 2, further comprising means swingably mounting said slide on said track for pivotal movement about an axis parallel to said track.

4. The combination defined in claim 2, further comprising means for swingably mounting said track for pivotal movement about a vertical axis perpendicular to said track relative to said table.

* * * * *